US006190300B1

(12) United States Patent
Demsia et al.

(10) Patent No.: US 6,190,300 B1
(45) Date of Patent: Feb. 20, 2001

(54) CENTRIFUGE ROTOR ADAPTED FOR USE WITH CENTRIFUGE TUBE STRIPS

(75) Inventors: Walter Demsia, Edison; H. Gerald Young, South Plainfield, both of NJ (US)

(73) Assignee: Labnet International Inc., Edison, NJ (US)

( * ) Notice: Under 35 U.S.C. 154(b), the term of this patent shall be extended for 0 days.

(21) Appl. No.: 09/523,390

(22) Filed: Mar. 10, 2000

(51) Int. Cl.[7] ..... B04B 5/02
(52) U.S. Cl. ..... 494/16
(58) Field of Search ..... 494/16, 17, 20, 494/33, 12; 422/72

(56) References Cited

U.S. PATENT DOCUMENTS

| | | | | |
|---|---|---|---|---|
| 486,390 | * | 11/1892 | Berg . | |
| 3,050,239 | * | 8/1962 | Williams, Jr. . | |
| 3,133,882 | * | 5/1964 | Mitchell et al. | 494/16 |
| 3,905,772 | * | 9/1975 | Hartnett et al. . | |
| 4,449,965 | | 5/1984 | Strain . | |
| 4,832,679 | | 5/1989 | Bader . | |
| 5,199,937 | * | 4/1993 | Wada et al. | 494/20 |
| 5,362,300 | | 11/1994 | Christensen . | |
| 5,538,493 | * | 7/1996 | Gerken et al. | 494/16 |
| 5,558,616 | * | 9/1996 | Barkus et al. | 494/12 |
| 5,683,659 | * | 11/1997 | Hovatter | 422/72 |
| 5,707,331 | * | 1/1998 | Wells et al. | 494/20 |
| 6,001,310 | * | 12/1999 | Shaffer et al. | 494/16 |
| 6,045,494 | * | 4/2000 | Toyama | 494/16 |

* cited by examiner

*Primary Examiner*—Charles E. Cooley
(74) *Attorney, Agent, or Firm*—Arthur L. Plevy; Buchanan Ingersoll PC

(57) ABSTRACT

A centrifuge rotor having a top surface, a bottom surface, side surface extending between the top and bottom surfaces, a centrally located bore for installing the rotor on a motor drive shaft of a centrifuge device, and at least one elongated aperture extending down and outwardly from the top surface of the rotor, the at least one elongated aperture for receiving a strip of interconnected centrifuge tubes. The rotor can also include an adapter for mounting the centrifuge tube strip in the at least one elongated aperture when the centrifuge tube strip is sized substantially smaller than the at least one elongated aperture.

16 Claims, 12 Drawing Sheets

CENTRIFUGE ROTOR ADAPTED FOR USE WITH CENTRIFUGE TUBE STRIPS

FIELD OF THE INVENTION

This invention relates to centrifuge rotors, and in particular, to a fixed angle centrifuge rotor which is especially adapted for use with centrifuge tube strips.

BACKGROUND OF THE INVENTION

Centrifuge devices are used for separating sample constituents according to density. These devices accomplish this by generating a very high "gravity" using centrifugal force. Typical centrifuge devices include rotors which are spun at high rotational speeds upwards of 15,000 rpm by a motor. Fixed angle rotors usually have a plurality of downwardly and outwardly angled apertures or wells which each receive a single tube containing a sample to be separated. The dense material in the sample settles out toward one the side of the tube, near the bottom, forming what is known as a "pellet".

Many current laboratory procedures involve repetitive centrifugation. To improve processing speed, linear arrays of molded plastic, rigidly interconnected centrifuge tubes, commonly referred to as centrifuge tube strips, have been developed. The axes of the tubes in these tube strips are parallel. Such centrifuge tube strips are convenient to handle, and by providing a constant predetermined centerline spacing, work well with automatic tube filling and sampling equipment such as multi-channel pipettes. Flexible centrifuge tube strips have also been developed. These tube strips employ a series of tubes which are interconnected near their mouths by flexible tethers that are molded with the tubes.

Unfortunately, these centrifuge tube strips can not be used in most conventional centrifuge rotors. Therefore, a need exits for a centrifuge rotor which can use both rigid and flexible centrifuge strips.

SUMMARY OF THE INVENTION

A centrifuge rotor comprising a top surface, a bottom surface, side surface extending between the top and bottom surfaces, a centrally located bore for installing the rotor on a motor drive shaft of a centrifuge device, and at least one elongated aperture extending down and outwardly from the top surface of the rotor, the at least one elongated aperture for receiving a strip of interconnected centrifuge tubes. The rotor can also comprise an adapter for mounting the centrifuge tube strip in the at least one elongated aperture when the centrifuge tube strip is sized substantially smaller than the at least one elongated aperture.

BRIEF DESCRIPTION OF THE DRAWINGS

The advantages, nature, and various additional features of the invention will appear more fully upon consideration of the illustrative embodiments now to be described in detail in connection with accompanying drawings wherein.

Figure 1A:
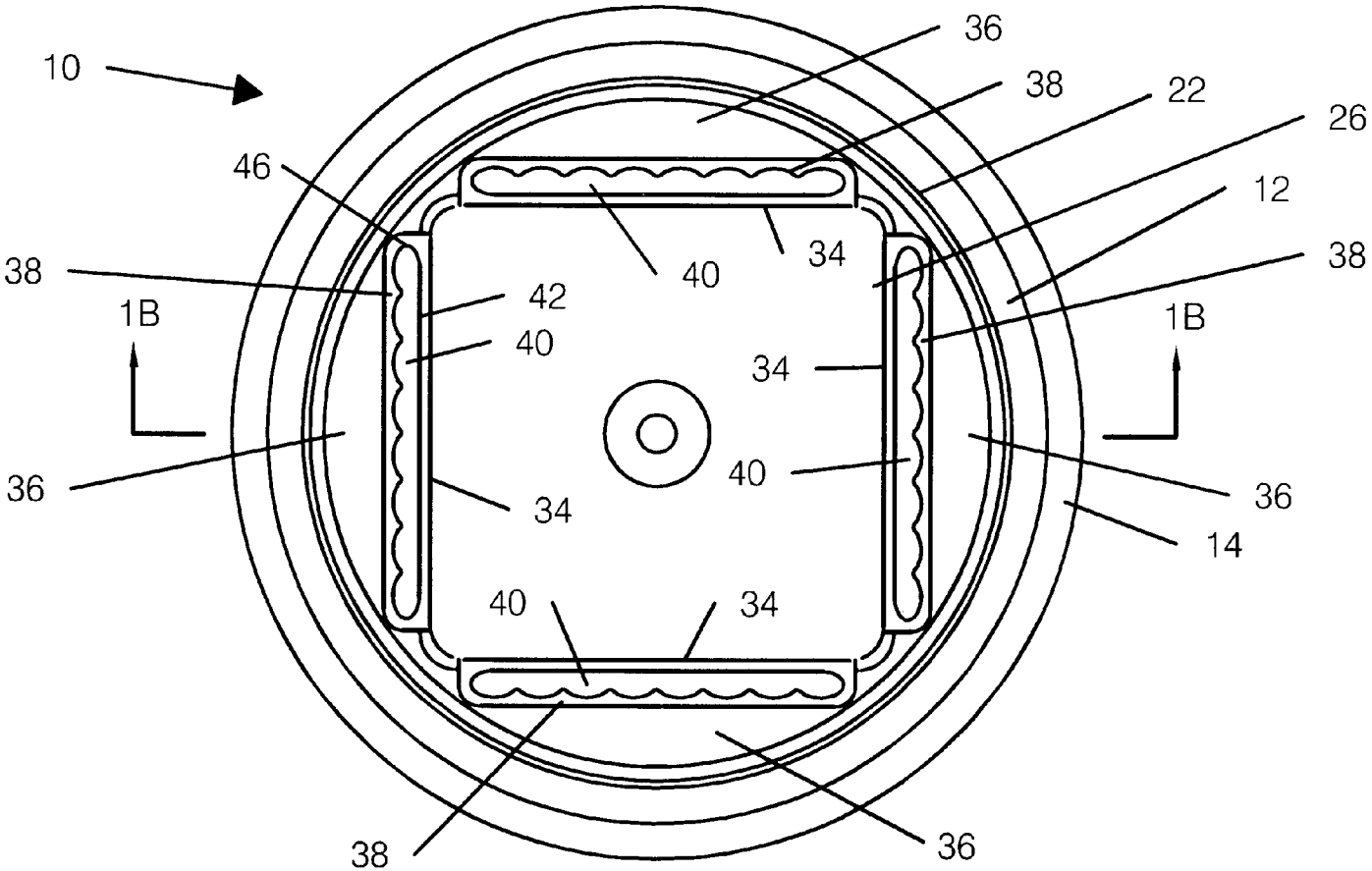
FIG. 1A is a top view of a centrifuge rotor according to an embodiment of the invention.
Figure 1B:
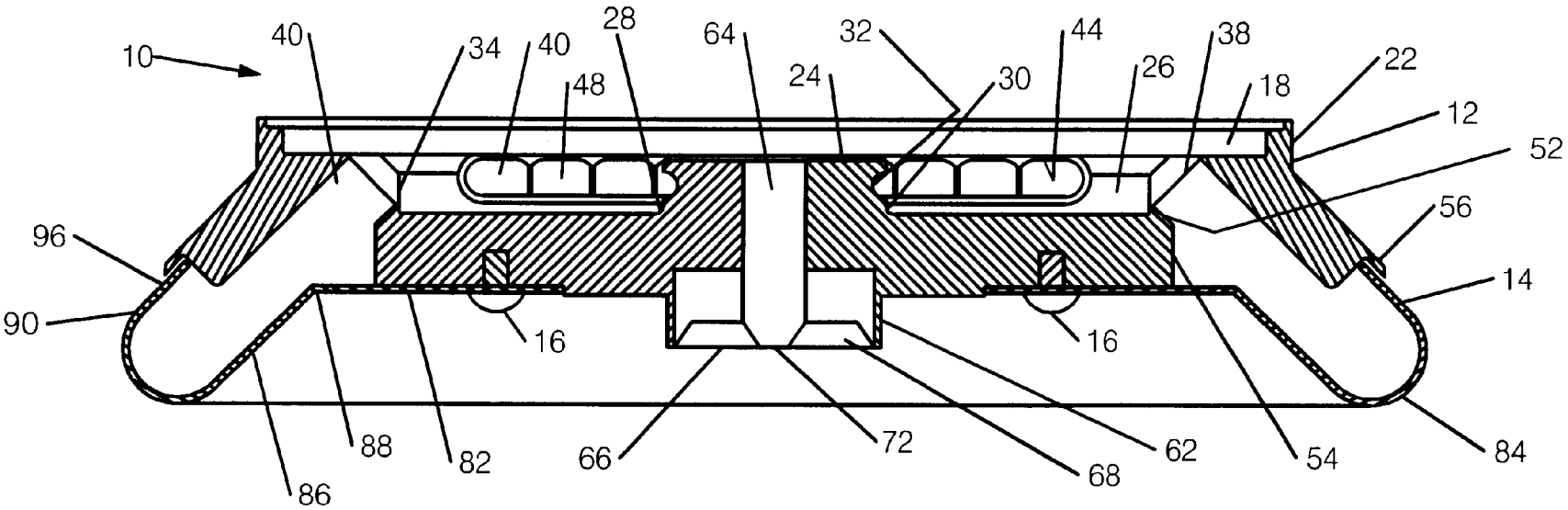
FIG. 1B is a cross-sectional view through line 1B—1B of the centrifuge rotor shown in FIG. 1A.
Figure 1C:
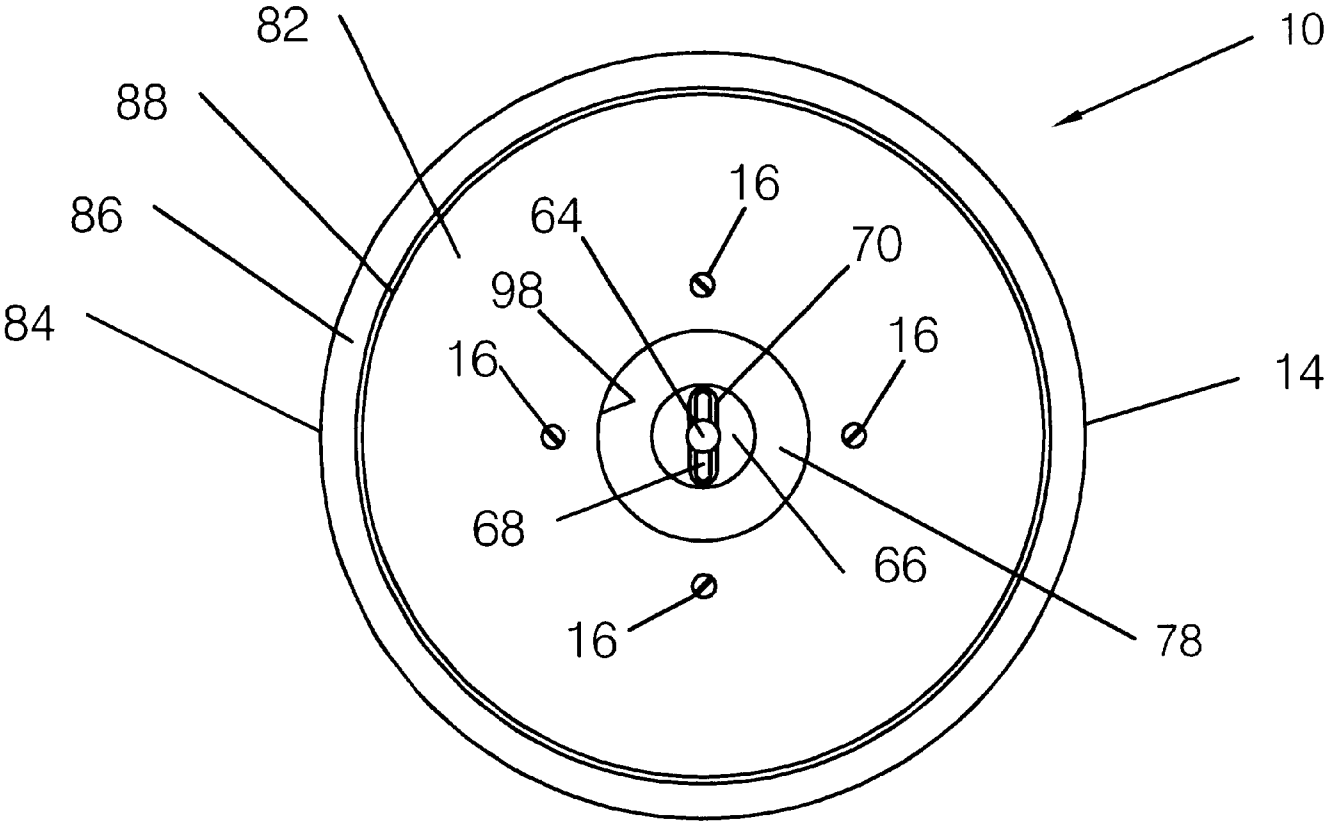
FIG. 1C is a bottom view the centrifuge rotor of FIG. 1A.

It should be understood that the drawings are for purposes of illustrating the concepts of the invention and are not to scale.

DETAILED DESCRIPTION OF THE INVENTION

FIGS. 1A–1D collectively show a centrifuge rotor 10 according to an exemplary embodiment of the invention. The rotor 10 is generally formed by upper and lower rotor sections 12, 14 which are typically held together by screw-threaded fasteners 16 or equivalent means.

The upper rotor section 12 is typically a frustoconical member having circular top and bottom surfaces 18, 20. The circular top surface 18 is bounded by an upstanding stepped rim 22, and has an upwardly extending cylindrical central member 24 surrounded by moat-like recess 26. The central member 24 defines an upper section of a centrally located drive hub 28, the outer surface 30 of which includes a groove 32 for manually handling the rotor 10.

Figure 1D:
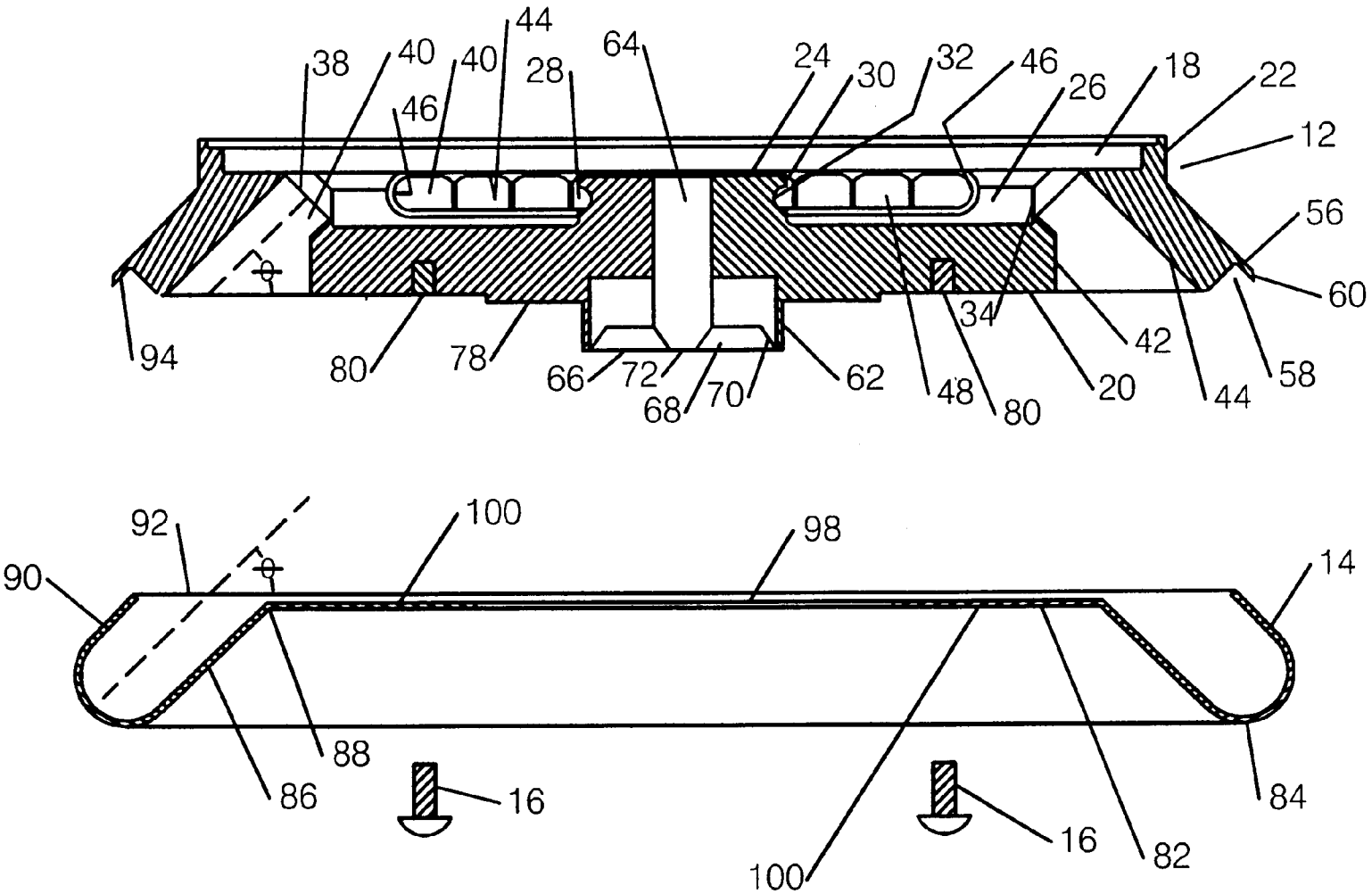
FIG. 1D is an exploded view of FIG. 1B.

In the shown embodiment, the recess 26 is substantially square in shape with four sidewalls 34 that extend down from peripheral outer portions 36 of the circular top surface 18. However, in other embodiments, the recess can be circular (with one sidewall), triangular (with three sidewalls), hexagonal (with six sidewalls) and so on. The top edge 38 of each recess sidewall 34 is beveled. A centrifuge tube strip receiving aperture 40 extends down and outwardly from each beveled edge 38, and extends through the circular bottom surface 20. The inclination angle $\theta_1$ of each aperture 40 is about forty-five (45) degrees as measured from the circular bottom surface 20 (FIG. 1D). Each aperture 40 is elongated and includes a bent inner surface 42, an inclined reverse-scalloped outer surface 44, and rounded end surfaces 46 connecting the inner and outer surfaces 42, 44. The reverse-scalloped outer surface 44 is formed by a series of rounded relief surfaces 48, which match the outer surface contour of an associated centrifuge tube strip 50 (FIGS.

3A–3D) as will be explained further on. The bent inner surface 42 includes a substantially flat, inclined surface portion 52 which extends about midway through the upper motor section 12, and a substantially flat, vertical surface portion 54 extending from the inclined surface portion 52 to the bottom surface 20 of the upper rotor section 12.

Figure 2:
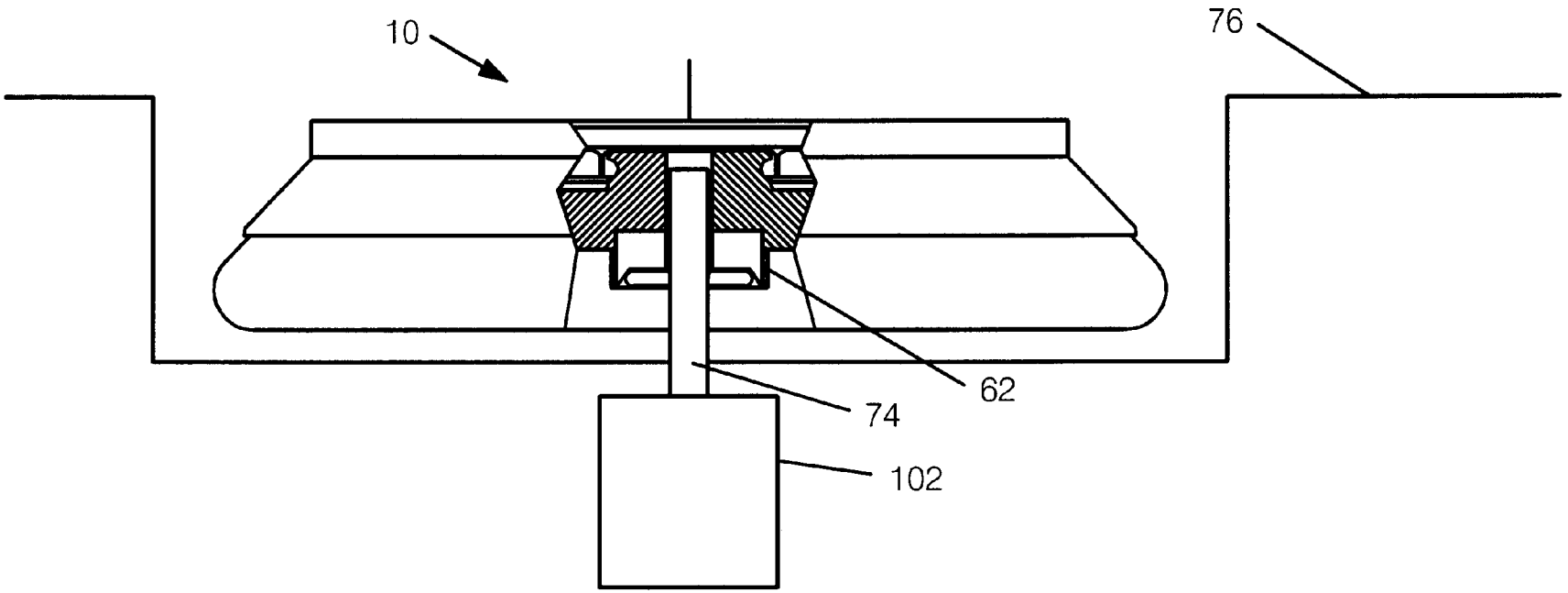
FIG.2 is a partial sectional view of the rotor as it is used in a centrifuge instrument.
Figure 3A:
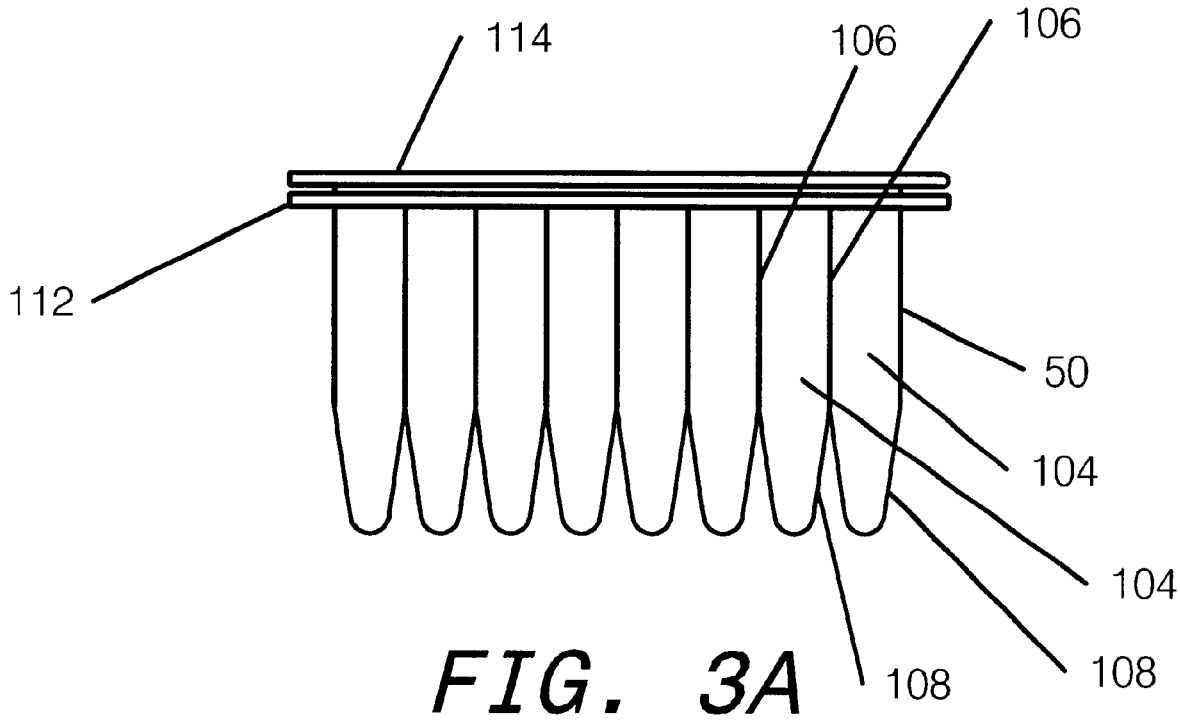
FIG. 3A (PRIOR ART)
FIG. 3A is a side elevational view of a prior art centrifuge tube strip which inserts in the rotor aperture without the use of the adapter.
Figure 3B:
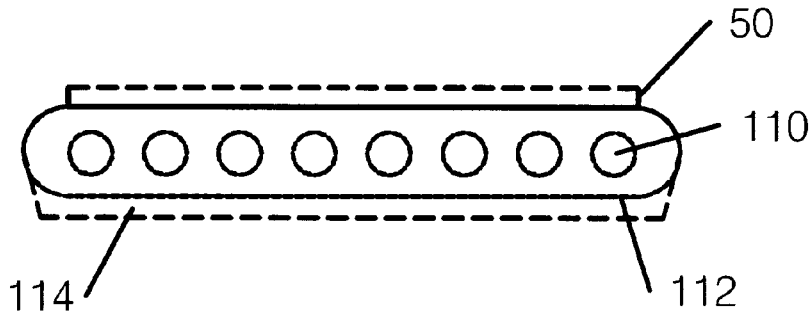
FIG. 3B (PRIOR ART)
FIG. 3B is a top view of the centrifuge tube strip shown in FIG. 3A.
Figure 3D:
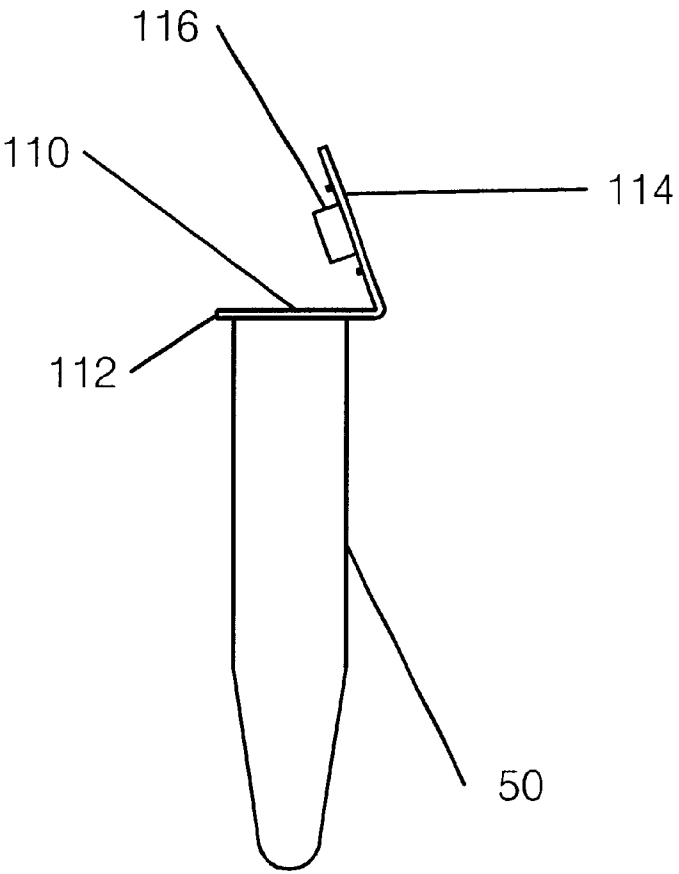
FIG. 3D (PRIOR ART)
FIG. 3D is an end elevational view of the centrifuge strip shown in FIG. 3A with its closure in the open position.
Figure 3C:
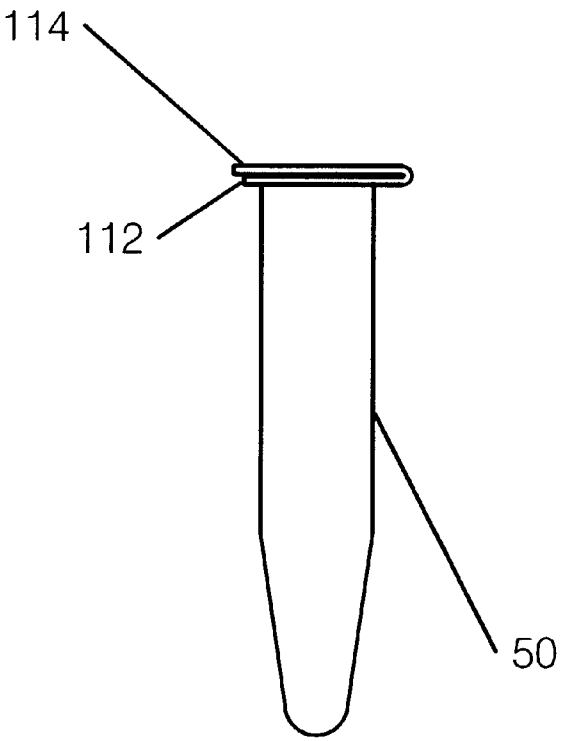
FIG. 3C (PRIOR ART)
FIG. 3C is an end elevational view of the centrifuge strip shown in FIG. 3A with its closure in the closed position.

The circular bottom surface 20 of the upper rotor 12 section includes a peripheral skirt 56 formed by an asymmetrical V-shaped annular groove 58 disposed just inside the peripheral edge 60 of the bottom surface 20. The earlier mentioned drive hub 28 includes a lower section 62 which projects down from the circular bottom surface 20. An open-ended bore 64 extends entirely through the drive hub 28. The face surface 66 of the lower drive hub section 62 includes an elongated slot 68. The edges 70 of at the bottom opening 72 of the bore 64 and the slot 68 are chamfered to facilitate mounting of the rotor 10 on a drive shaft 74 of a centrifuge instrument 76 (FIG. 2). The lower drive hub section 62 is encircled by a raised annular member 78 that projects down from the circular bottom surface 20. A plurality of threaded, closed-ended fastener apertures 80 extend about the annular member 78.

The lower rotor section 14 includes a disc member 82 surrounded by annular well member 84 which extends down and outwardly from the elongated apertures 40. The annular well member 84 is formed by a frustoconical section 86 which extends from the periphery 88 of the disc member 82, and a upturned rim section 90. The well member 84 has an angle $\theta_2$ of inclination of about forty-five (45) degrees as measured from disc member 82, which matches the inclination of the centrifuge tube strip apertures 40. The edge 92 of the upturned rim section 90 abuts against the inner surface 94 of the groove 58 such that the skirt 56 of the upper rotor section 12 somewhat overlaps the outer surface 96 of upturned rim section 90 of the lower rotor section 14. The disc member 82 includes a central opening 98 that permits the annular member 78 and the lower drive hub section 62 of the upper rotor section 12 to extend therethrough. The central opening 98 is surrounded by a plurality of fastener holes 100 which align with the fastener apertures 80 defined in the circular bottom surface 20 of the upper rotor section 12. The screw-fasteners 16 extend through the fastener holes 100 and thread into the fastener apertures 80, securing the upper and lower rotor sections 12, 14 together.

The upper and lower rotor sections 12, 14 are fabricated from any suitable material. The upper rotor section 12 is preferably fabricated from 7075 T6 aluminum, using conventional machining techniques or equivalent methods. The lower rotor section 14 is preferably fabricated from aluminum, using conventional stamping techniques or equivalent methods. Although not shown herein, the upper and lower rotor sections 12, 14 can be constructed as a single unitary member in other embodiments of the invention, thus eliminating the need for fasteners 16 and their associated apertures 80 and holes 100.

FIG. 2 shows the centrifuge rotor 10 of the invention mounted to the drive shaft 74 of an exemplary centrifuge instrument 76. The drive shaft 74 is connected to a motor 102. The rotor 10 of the invention is designed to be rotated by the centrifuge instrument 76 at speeds between about 12,000 to 14,000 rpm. The drive hub 28 of the rotor 10 permits it to be used with many existing centrifuge instruments. Moreover, the drive hub 28 of the rotor 10 and can be easily adapted to enable the rotor to be used with other existing and future centrifuge instrument designs.

FIGS. 3A–3D show the earlier mentioned centrifuge tube strip 50. The centrifuge tube strip 50 is molded from a plastic material such as polypropylene, and is formed by an inline array of centrifuge tubes 104 which are rigidly interconnected along their sides 106 and have tapered end portions 108. The mouths 110 of the tubes 104 are surrounded by a flange 112 which hingedly couples a pivoting closure 114 that includes a plurality of plug elements 116 which enter and seal the mouths 110 of the tubes 104 when the closure 114 is pivoted into the closed position. These centrifuge tube strips 50 improve processing speed and are convenient to handle because they provide a constant predetermined centerline spacing, work well with automatic tube filling and sampling equipment such as multi-channel pipettes (not shown). Centrifuge tube strips 50 similar to the one shown in FIGS. 3A–3D, are available from Denville Scientific Inc. of Metuchen, N.J.

Figure 4A:
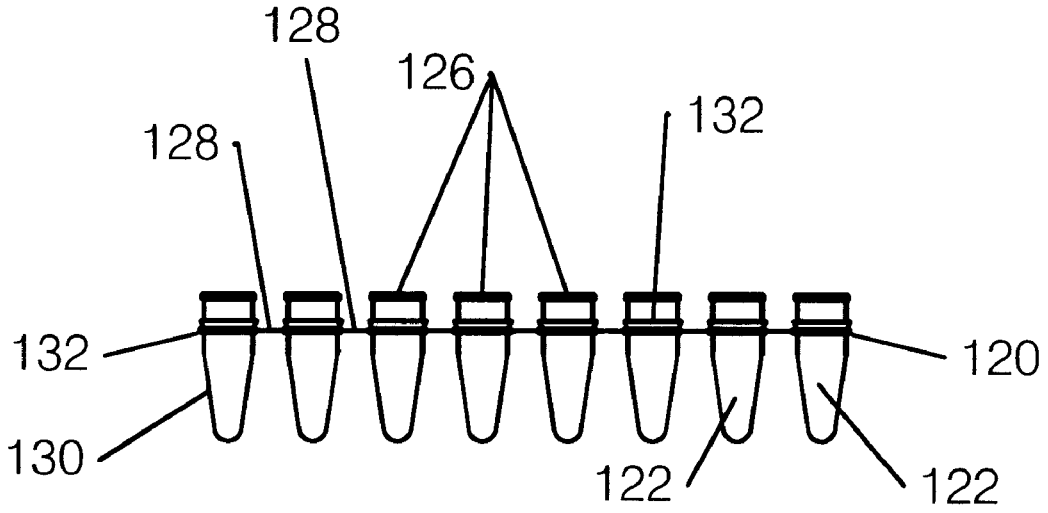
FIG. 4A (PRIOR ART)
FIG. 4A is a side elevational view of a prior art centrifuge tube strip which inserts in the rotor aperture with the use of an adapter.
Figure 4B:
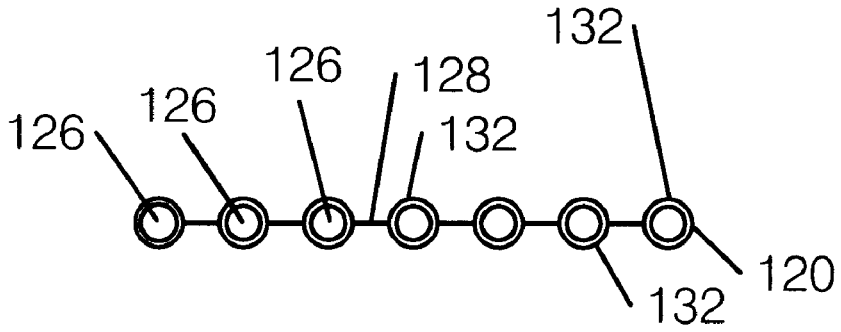
FIG. 4B (PRIOR ART)
FIG. 4B is a top view of the centrifuge tube strip shown in FIG. 4A.

FIGS. 4A and 4B collectively show another type of centrifuge tube strip 120 which can be used with the rotor 10 of the invention. This centrifuge strip 120 is also molded from plastic material such as polypropylene and includes an inline array of plastic centrifuge tubes 122 which are flexibly interconnected adjacent their mouths 126 by flexible tethers 128 that are molded with the tubes 122. The tubes 122 have tapered end portions 130 and a thickened collar 132 formed around the mouth 126 of each tube 122. The tubes 122 of the tube strip 120 have dimensions which are substantially less than the tubes 104 of the centrifuge tube strip 50 shown in FIGS. 3A–3D. Centrifuge tube strips 120 similar to the one shown in FIGS. 4A and 4B, are available from Denville Scientific Inc. of Metuchen, N.J.

Figure 5A:
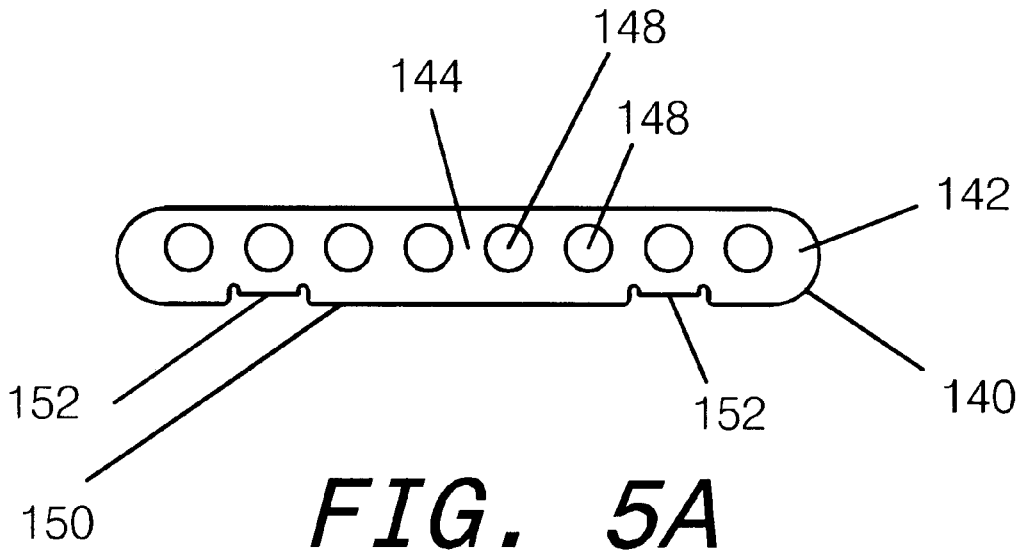
FIG. 5A is a front view of a centrifuge tube strip adapter used with the centrifuge rotor of the invention.
Figure 5B:
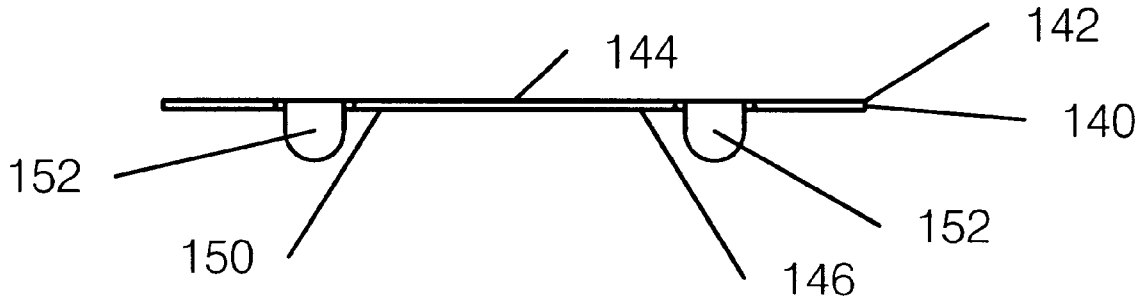
FIG. 5B is a rear view of the adapter shown in FIG. 5A.
Figure 6:
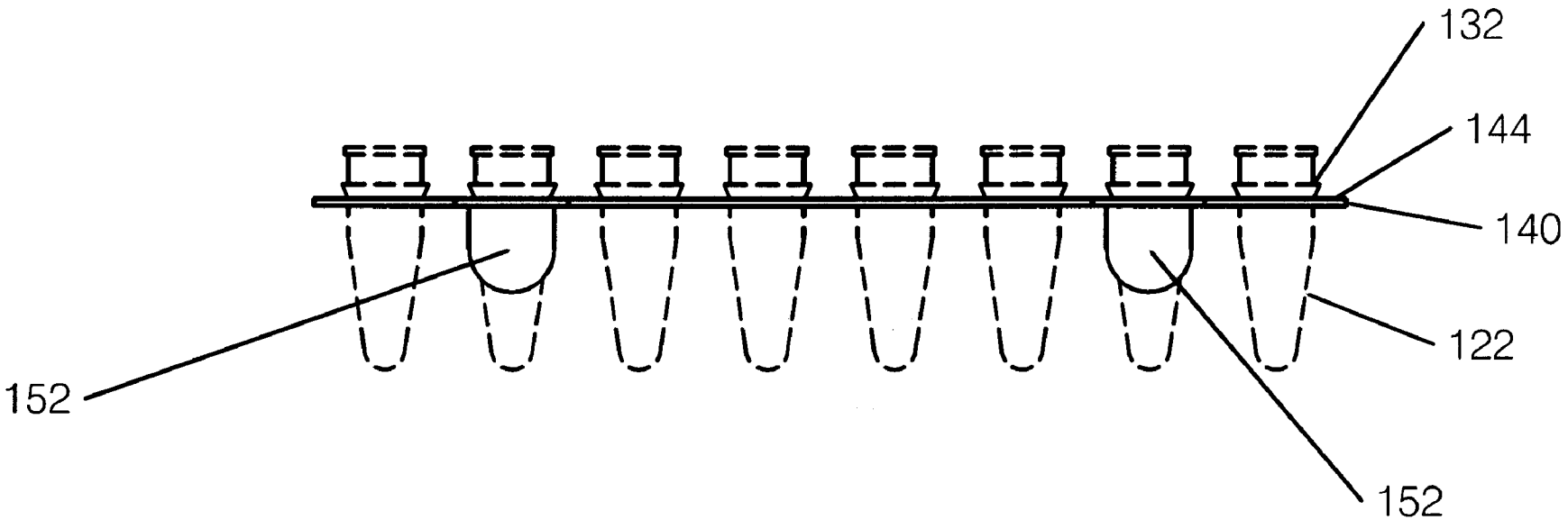
FIG. 6 is a side elevational view of the centrifuge strip shown in FIGS. 4A and 4B mounted in the adapter shown in FIGS. 5A and 5B.

FIGS. 5A and 5B collectively show an adapter 140 which is provided in the invention for accommodating the tube strips 120 shown in FIGS. 4A and 4B in the apertures 40 of the rotor 10. The adapter 140 comprises an elongated planar member 142 having front and rear faces 144, 146, and a plurality of apertures 148 which are spaced and dimensioned to receive the tethered tubes 122 of the centrifuge tube strip 120. The diameter of the apertures 148 are sized so that the thickened collars 132 of the tubes 122 rest on the front face 144 of the adapter 140 (FIG. 6) to suspend the tubes 122 in the apertures 40 of the rotor 10. One side edge 150 of the adapter 140 includes a pair of bent tabs 152 that extend perpendicularly away from the rear face 146 of the adapter 140.

Figure 7A:
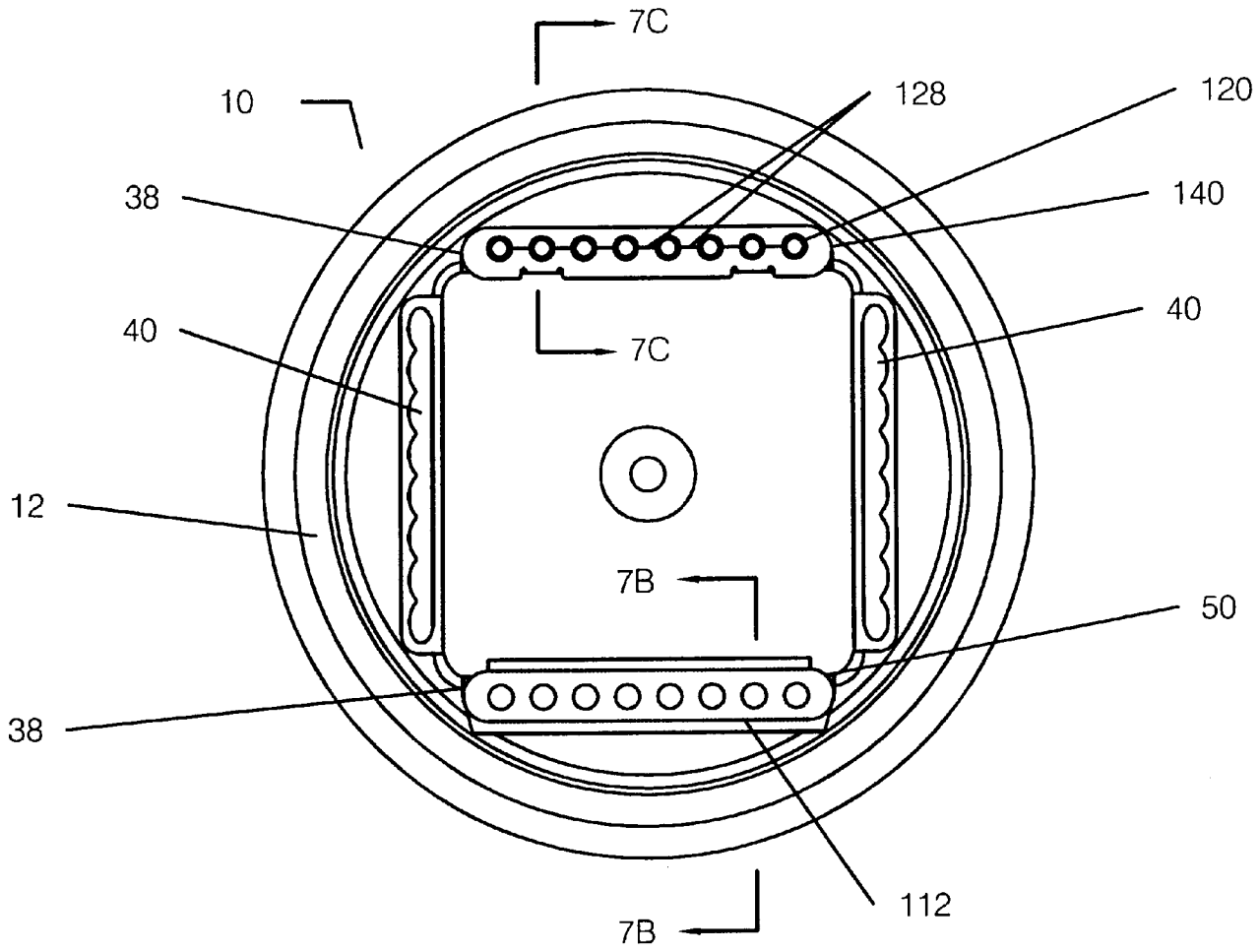
FIG. 7A is a top view of the centrifuge rotor with the centrifuge tube strip shown in FIGS. 3A–3D inserted in one of the rotor's centrifuge tube strip apertures, and the centrifuge tube strip shown in FIGS. 4A and 4B inserted in another one of the rotor's centrifuge tube strip apertures using the adapter shown in FIGS. 5A and 5B.
Figure 7C:
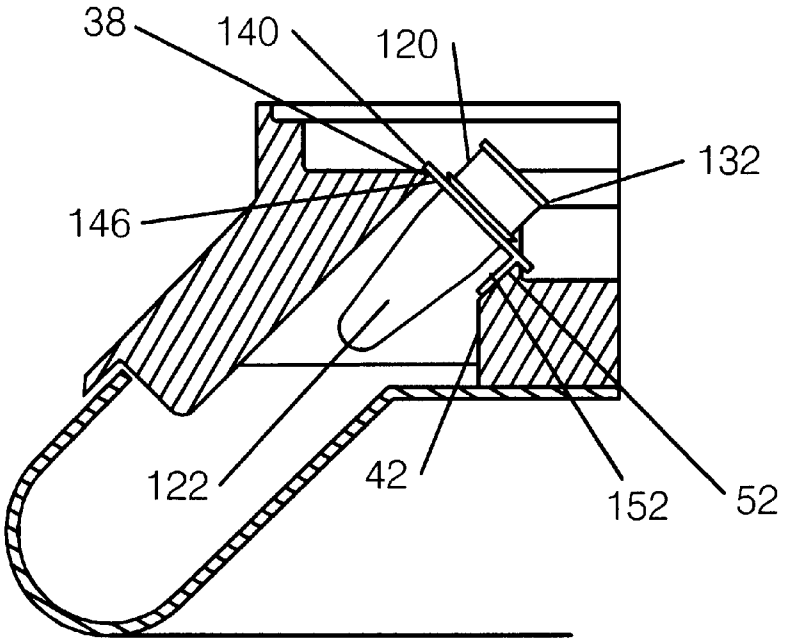
FIG. 7C is a partial sectional view through line 7C—7C of FIG. 7A.
Figure 7B:
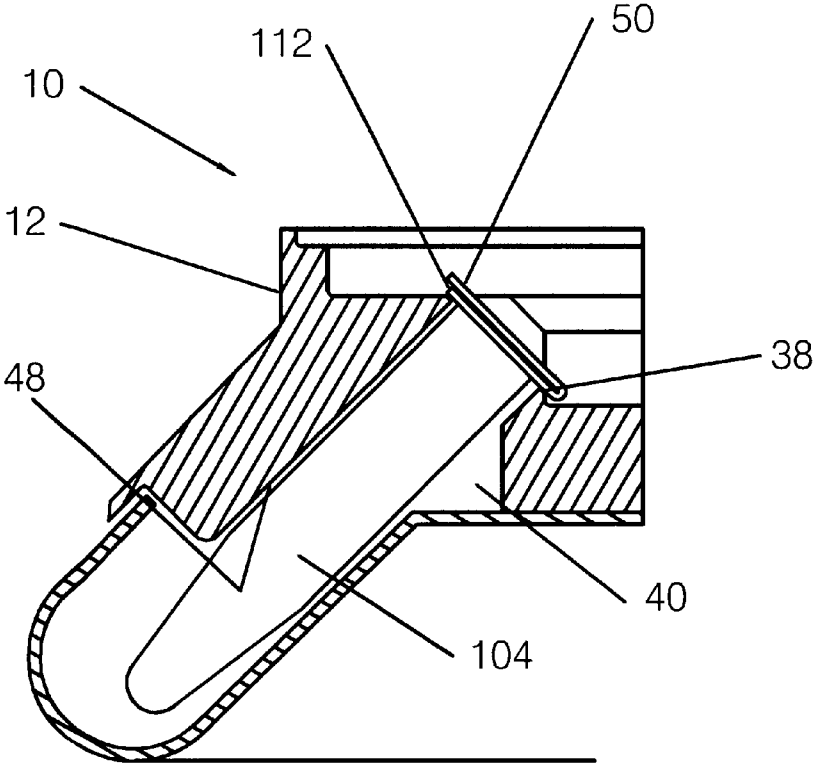
FIG. 7B is a partial sectional view through line 7B—7B of FIG. 7A.

FIGS. 7A and 7B collectively show the centrifuge tube strip 50 shown in FIGS. 3A–3D inserted in one the centrifuge tube strip apertures 40 of the rotor 10 of the invention. As can be seen, the flange 112 (shown with broken lines) of the centrifuge tube strip 50 abuts against the beveled top edge 38 of the upper rotor section12, suspending the centrifuge tubes 104 in the aperture 40. The rounded outer relief surfaces 48 of the apertures 40 (only one is visible) are dimensioned so that they support major portions of the tubes 104 (only the tapered end portions 108 are left unsupported) which is critical for failure free operation during high speed rotation of the rotor 10 at approximately 12,000 to 14,000 rpm. Without such support, the centrifugal forces sustained by the tubes 104 of the strip 50 during such high speed rotation would likely damage and/or cause the tubes 104 to fail and leak.

FIGS. 7A and 7C collectively show the tethered centrifuge tube strip 120 shown in FIGS. 4A and B inserted in one of the other apertures 40 of the rotor 10 using the adapter 140. When the adapter 140 is mounted over the aperture 40 of the rotor 10, the rear face 146 of the adapter 140 abuts against the beveled top edge 38 and the tabs 152 enter the aperture 40 and rest on the inclined portion 52 of the bent inner surface 42 thereof to properly center the apertures 148 of the adapter within the aperture 40. Thus, the adapter 140 suspends the tubes 122 of the strip 120 in the aperture 40. Because the tubes 122 of the strip 120 are much smaller, it has been found generally unnecessary to support the tubes 122 with the rounded outer relief surfaces 48 of the aperture 40 as with the larger centrifuge strips 50.

While the foregoing invention has been described with reference to the above embodiments, various modifications and changes can be made without departing from the spirit of the invention. Accordingly, all such modifications and changes are considered to be within the scope of the appended claims.

What is claimed is:

1. A centrifuge rotor comprising:

a top surface;

a bottom surface;

a side surface extending between the top and bottom surfaces;

a centrally located bore for installing the rotor on a motor drive shaft of a centrifuge device; and at least one elongated aperture for receiving a strip of interconnected centrifuge tubes, the at least one elongated aperture extending down and outwardly from the top surface of the rotor and defining an inclined reverse-scalloped outer surface.

2. The centrifuge rotor according to claim 1, wherein the at least one elongated aperture has an inclination angle of about forty-five (45) degrees as measured from the bottom surface.

3. The centrifuge rotor according to claim 1, wherein the at least one elongated aperture further defines a bent inner surface and rounded end surfaces connecting the inner and outer surfaces.

4. The centrifuge rotor according to claim 3, wherein the bent inner surface includes an inclined surface portion which extends from the top surface and merges with a substantially flat, vertical surface portion.

5. The centrifuge rotor according to claim 1, wherein the reverse-scalloped outer surface is formed by a series of rounded relief surfaces which match the outer surface contour of the centrifuge tube strip to be received therein.

6. The centrifuge rotor according to claim 1, further comprising an adapter for mounting the centrifuge tube strip in the at least one elongated aperture when the centrifuge tube strip is sized substantially smaller than the at least one elongated aperture.

7. The centrifuge rotor according to claim 6, wherein the adapter includes an elongated planar member having a plurality of apertures which are spaced and dimensioned to receive the centrifuge tube strip.

8. A centrifuge rotor comprising:

a circular top surface;

a circular bottom surface;

a side surface extending between the top and bottom surfaces;

a centrally located bore for installing the rotor on a motor drive shaft of a centrifuge device; and a plurality of elongated apertures for receiving strips of interconnected centrifuge tubes, the apertures extending down and outwardly from the top surface of the rotor and each defining an inclined reverse-scalloped outer surface.

9. The centrifuge rotor according to claim 8, wherein the elongated apertures each have an inclination angle of about forty-five (45) degrees as measured from the bottom surface.

10. The centrifuge rotor according to claim 8, wherein each of the elongated apertures further defines a bent inner surface and rounded end surfaces connecting the inner and outer surfaces.

11. The centrifuge rotor according to claim 10, wherein the bent inner surface includes an inclined surface portion which extends from the top surface and merges with a substantially flat, vertical surface portion.

12. The centrifuge rotor according to claim 8, wherein the reverse-scalloped outer surface is formed by a series of rounded relief surfaces which match the outer surface contour of the centrifuge tube strip to be received therein.

13. The centrifuge rotor according to claim 8, further comprising a plurality of adapters for mounting the centrifuge tube strips in the elongated apertures when the centrifuge tube strips are sized substantially smaller than the elongated apertures.

14. The centrifuge rotor according to claim 13, wherein each of the adapters includes an elongated planar member having a plurality of apertures which are spaced and dimensioned to receive the centrifuge tube strip.

15. The centrifuge rotor according to claim 14, wherein each of the adapters further includes at least one bent tab that extends perpendicularly from the plane of the planar member and enters a corresponding one of the elongated apertures when the adapter is mounted over the opening thereof.

16. A centrifuge rotor comprising:

an upper rotor section having a circular top surface, a circular bottom surface, a side surface extending between the top and bottom surfaces, a centrally located bore for installing the rotor on a motor drive shaft of a centrifuge device, and a plurality of elongated apertures for receiving strips of interconnected centrifuge tubes, the elongated apertures extending down and outwardly between the top and bottom surfaces thereof and defining an inclined reverse-scalloped outer surface; and a lower rotor section coupled to the upper rotor section, the lower rotor section having a disc member surrounded by annular well member which extends down and outwardly from the apertures.

* * * * *